US009234396B2

(12) United States Patent
Marland et al.

(10) Patent No.: US 9,234,396 B2
(45) Date of Patent: Jan. 12, 2016

(54) SYSTEMS AND METHODS FOR MONITORING AND CHARACTERIZING FLUIDS IN A SUBTERRANEAN FORMATION USING HOOKLOAD

(71) Applicant: Halliburton Energy Services, Inc., Houston, TX (US)

(72) Inventors: Christopher Marland, Spring, TX (US); Ian Mitchell, Montgomery, TX (US); James Randolph Lovorn, Tomball, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 17 days.

(21) Appl. No.: 14/373,200

(22) PCT Filed: Jan. 28, 2013

(86) PCT No.: PCT/US2013/023408

§ 371 (c)(1),
(2) Date: Jul. 18, 2014

(87) PCT Pub. No.: WO2014/116248

PCT Pub. Date: Jul. 31, 2014

(65) Prior Publication Data

US 2015/0330167 A1 Nov. 19, 2015

(51) Int. Cl.
*G01V 1/40* (2006.01)
*E21B 21/08* (2006.01)
(Continued)

(52) U.S. Cl.
CPC ..... *E21B 21/08* (2013.01); *E21B 47/0006* (2013.01); *E21B 47/065* (2013.01); *E21B 49/08* (2013.01)

(58) Field of Classification Search
CPC ..... E21B 44/00; E21B 19/09; B66D 1/50; G09G 5/003; Y10S 254/90; Y10S 254/9043
USPC ..... 702/6; 175/5, 27, 40; 254/270, 274, 254/337, 340, 358, 367, 900, 903
See application file for complete search history.

(56) References Cited

U.S. PATENT DOCUMENTS 3,833,076 A * 9/1974 Griffin, III ..... E21B 21/08 175/38
3,991,837 A * 11/1976 Crickmer ..... E21B 19/09 175/27

(Continued)

FOREIGN PATENT DOCUMENTS

WO 2013/000094 A1 1/2013

OTHER PUBLICATIONS

International Preliminary Report on Patentability issued in related PCT Application No. PCT/US2013/023408, mailed on Aug. 6, 2015 (7 pages).

(Continued)

*Primary Examiner* — Carol S Tsai
(74) *Attorney, Agent, or Firm* — John W. Wustenberg; Baker Botts L.L.P.

(57) ABSTRACT

Systems and methods for monitoring and characterizing fluids in a subterranean formation are provided. In one embodiment, a method for monitoring fluids in a well bore penetrating a subterranean formation is provided, the method comprising: determining an actual buoyed hookload of an apparatus at least partially disposed in the well bore wherein a first set of fluids are present therein; comparing the actual buoyed hookload to a calculated buoyed hookload of the apparatus, wherein the calculated buoyed hookload is based in part on the unbuoyed hookload of the apparatus, and the properties of a second set of fluids that are assumed to be present in the well bore; and determining at least one property of the first set of fluids based in part on the comparison of the actual buoyed hookload to the calculated buoyed hookload.

20 Claims, 3 Drawing Sheets

(51) Int. Cl.

| | |
|---|---|
| ***E21B 49/08*** | (2006.01) |
| ***E21B 47/06*** | (2012.01) |
| ***E21B 47/00*** | (2012.01) |

(56) References Cited

U.S. PATENT DOCUMENTS

| | | | | |
|---|---|---|---|---|
| 4,909,327 | A * | 3/1990 | Roche | E21B 17/017 166/359 |
| 5,894,895 | A * | 4/1999 | Welsh | B66C 13/02 175/40 |
| 6,176,323 | B1 | 1/2001 | Weirich et al. | |
| 8,615,082 | B1 * | 12/2013 | Selman | E21B 47/00 340/853.2 |
| 8,615,660 | B1 * | 12/2013 | Selman | H04L 69/18 340/853.2 |
| 9,074,455 | B2 * | 7/2015 | Pilgrim | E21B 7/00 1/1 |
| 2004/0040746 | A1 | 3/2004 | Niedermayr et al. | |
| 2012/0037361 | A1 * | 2/2012 | Santos | E21B 21/08 166/250.08 |
| 2012/0043079 | A1 | 2/2012 | Wassouf et al. | |
| 2013/0025937 | A1 * | 1/2013 | Pilgrim | E21B 44/00 175/24 |
| 2013/0346754 | A1 * | 12/2013 | Selman | H04L 69/18 713/175 |
| 2014/0260592 | A1 * | 9/2014 | Mason | E21B 47/0006 73/152.59 |

OTHER PUBLICATIONS

International Search Report and Written Opinion issued in related International Application No. PCT/US2013/023408 mailed Oct. 9, 2013, 9 pages.

* cited by examiner

SYSTEMS AND METHODS FOR MONITORING AND CHARACTERIZING FLUIDS IN A SUBTERRANEAN FORMATION USING HOOKLOAD

CROSS-REFERENCE TO RELATED APPLICATION

This application is a U.S. National Stage Application of International Application No. PCT/US2013/023408 filed Jan. 28, 2013, which is hereby incorporated by reference in its entirety.

BACKGROUND

The present disclosure relates to subterranean operations and, more particularly, to systems and methods for monitoring and characterizing fluids in a subterranean formation.

Performance of subterranean operations entails various steps, each using a number of devices. Many subterranean operations entail introducing one or more fluids into the subterranean formation. For instance, drilling operations play an important role when developing oil, gas or water wells or when mining for minerals and the like. During the drilling operations, a drill bit passes through various layers of earth strata as it descends to a desired depth. Drilling fluids are commonly employed during the drilling operations and perform several important functions including, but not limited to, removing the cuttings from the well to the surface, controlling formation pressures, sealing permeable formations, minimizing formation damage, and cooling and lubricating the drill bit.

Similarly, other treatment fluids may be used when performing subterranean operations. One common production stimulation operation that employs one or more treatment fluids is hydraulic fracturing. Hydraulic fracturing operations generally involve pumping a treatment fluid (e.g., a fracturing fluid) into a well bore that penetrates a subterranean formation at a sufficient hydraulic pressure to create or enhance one or more cracks, or "fractures," in the subterranean formation. Other examples of treatment fluids used in subterranean operations include, but are not limited to, preflush fluids, afterflush fluids, wellbore cleaning fluids, consolidating fluids, gravel packing fluids, acidizing fluids, and the like.

Maintaining fluid pressure in the well bore is often critical to these and other subterranean operations in a well bore. However, fluids placed in a well bore may migrate or flow into another portion of the subterranean formation other than their intended location, for example, in an area of the formation that is more porous or permeable. Fluid loss may result in, among other problems, incomplete or ineffective treatment of the formation, increased cost due to increased volumes of fluid to complete a treatment, and/or environmental contamination of the formation. While treatment fluids are often formulated and wells are often constructed so as to reduce the likelihood or amount of fluid loss into the formation, fluid loss still may occur, particularly in damaged or highly permeable areas of a subterranean formation or well bore.

Conventional methods of detecting fluid loss typically involve measuring the amount of fluid pumped into the well bore and comparing that with the amount of fluid circulated out of the well bore. However, such methods are usually only performed after the operation using the fluid has been completed, and do not give an operator enough information during the operation to make adjustments to attempt to compensate for the fluid loss or otherwise remedy whatever is causing the loss of fluid. This may require performing the same treatment or operation on the same well bore multiple times until it can be performed without significant fluid loss. Moreover, such methods typically are not capable of identifying the specific fluid that was lost into the formation, the identity of which may be important in order to compensate for the lost fluid and/or remedy or prevent additional problems (e.g., formation damage, environmental problems, etc.) that may result from the loss of particular fluids into the formation.

BRIEF DESCRIPTION OF THE FIGURES

These drawings illustrate certain aspects of some of the embodiments of the present disclosure, and should not be used to limit or define the disclosure.

Figure 1:
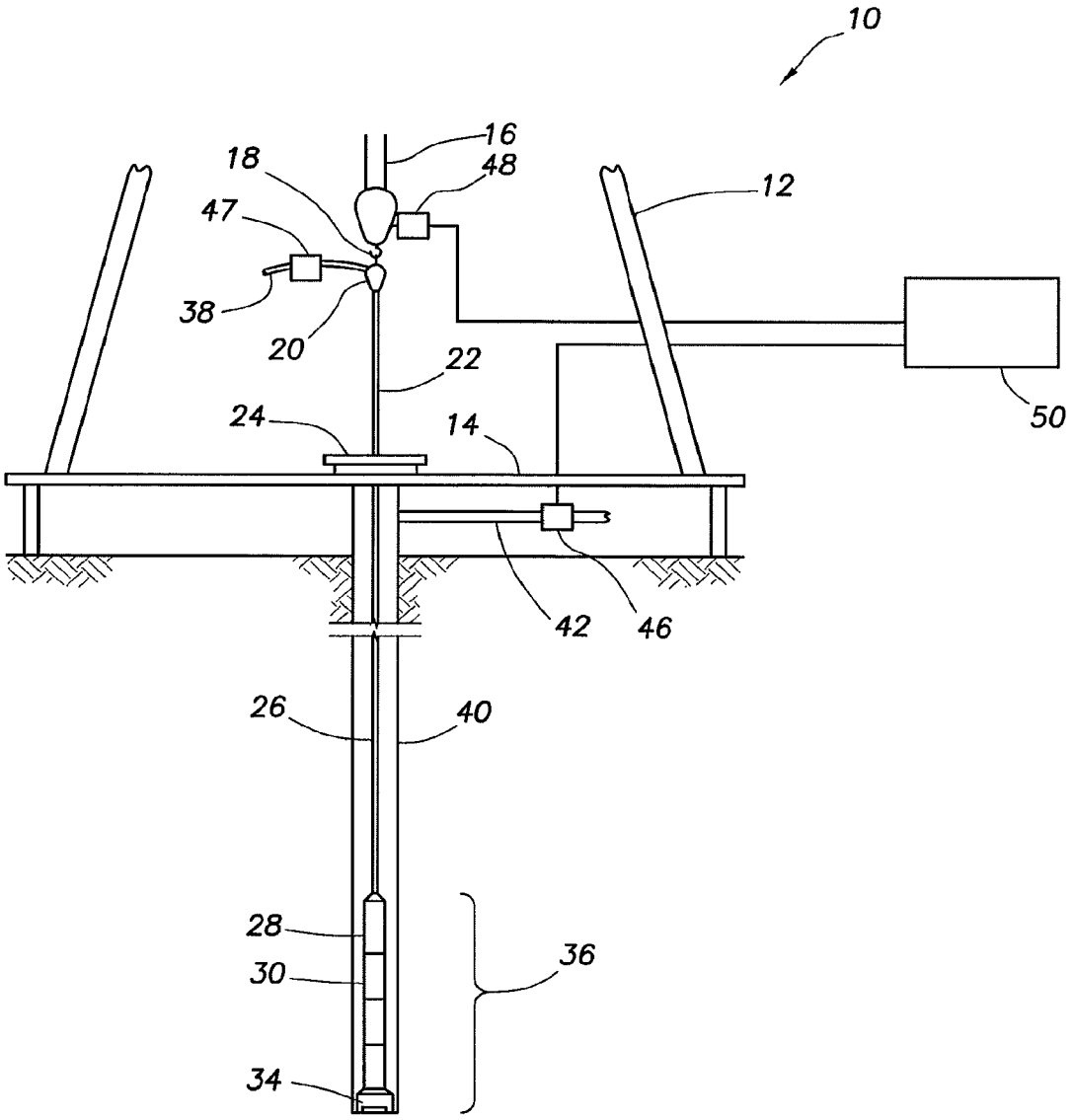
FIG. 1 depicts a drilling rig and drilling operation.

While embodiments of this disclosure have been depicted and described and are defined by reference to example embodiments of the disclosure, such references do not imply a limitation on the disclosure, and no such limitation is to be inferred. The subject matter disclosed is capable of considerable modification, alteration, and equivalents in form and function, as will occur to those skilled in the pertinent art and having the benefit of this disclosure. The depicted and described embodiments of this disclosure are examples only, and not exhaustive of the scope of the disclosure.

DETAILED DESCRIPTION

Illustrative embodiments of the present disclosure are described in detail herein. In the interest of clarity, not all features of an actual implementation may be described in this specification. It will of course be appreciated that in the development of any such actual embodiment, numerous implementation-specific decisions may be made to achieve the specific implementation goals, which may vary from one implementation to another. Moreover, it will be appreciated that such a development effort might be complex and time-consuming, but would nevertheless be a routine undertaking for those of ordinary skill in the art having the benefit of the present disclosure.

For purposes of this disclosure, an information handling system may include any instrumentality or aggregate of instrumentalities operable to compute, classify, process, transmit, receive, retrieve, originate, switch, store, display, manifest, detect, record, reproduce, handle, or utilize any form of information, intelligence, or data for business, scientific, control, or other purposes. For example, an information handling system may be a personal computer or tablet device, a cellular telephone, a network storage device, or any other suitable device and may vary in size, shape, performance, functionality, and price. The information handling system may include random access memory (RAM), one or more processing resources such as a central processing unit (CPU) or hardware or software control logic, ROM, and/or other types of nonvolatile memory. Additional components of the information handling system may include one or more disk drives, one or more network ports for communication with external devices as well as various input and output (I/O) devices, such as a keyboard, a mouse, and a video display. The information handling system may also include one or more buses operable to transmit communications between the various hardware components.

For the purposes of this disclosure, computer-readable media may include any instrumentality or aggregation of instrumentalities that may retain data and/or instructions for a period of time. Computer-readable media may include, for example, without limitation, storage media such as a direct access storage device (e.g., a hard disk drive or floppy disk drive), a sequential access storage device (e.g., a tape disk drive), compact disk, CD-ROM, DVD, RAM, ROM, electrically erasable programmable read-only memory (EEPROM), and/or flash memory; as well as communications media such wires, optical fibers, microwaves, radio waves, and other electromagnetic and/or optical carriers; and/or any combination of the foregoing.

The terms "couple" or "couples," as used herein are intended to mean either an indirect or a direct connection. Thus, if a first device couples to a second device, that connection may be through a direct connection, or through an indirect electrical connection via other devices and connections. The term "communicatively coupled" as used herein is intended to mean coupling of components in a way to permit communication of information therebetween. Two components may be communicatively coupled through a wired or wireless communication network, including but not limited to Ethernet, LAN, fiber optics, radio, microwaves, satellite, and the like. Operation and use of such communication networks is well known to those of ordinary skill in the art and will, therefore, not be discussed in detail herein.

It will be understood that the term "oil well drilling equipment" or "oil well drilling system" is not intended to limit the use of the equipment and processes described with those terms to drilling an oil well. The terms also encompass drilling natural gas wells or hydrocarbon wells in general. Further, such wells can be used for production, monitoring, or injection in relation to the recovery of hydrocarbons or other materials from the subsurface. This could also include geothermal wells intended to provide a source of heat energy instead of hydrocarbons.

The present disclosure relates to subterranean operations and, more particularly, to systems and methods for monitoring and characterizing fluids in a subterranean formation.

As shown in FIG. 1, a simplified view of a drilling rig 10 is shown that comprises a derrick 12, derrick floor 14, draw works 16, hook 18, swivel 20, kelly joint 22, rotary table 24, drillstring 26, drill collar 28, LWD tools 30, and drill bit 34. One or more drilling fluids (commonly referred to as "mud") are injected into the swivel by a mud supply line 38. The mud travels through the kelly joint 22, drillstring 26, drill collars 28, and LWD tools 30, exits through jets or nozzles in the drill bit 34, and then flows up the borehole 40. A mud return line 42 returns mud from the borehole 40 and circulates it to a mud pit (not shown) and back to the-mud supply line 38. The combination of the drill collar 28, LWD tools 30, and drill bit 34 is known as the bottomhole assembly 36 (or "BHA").

Figure 2:
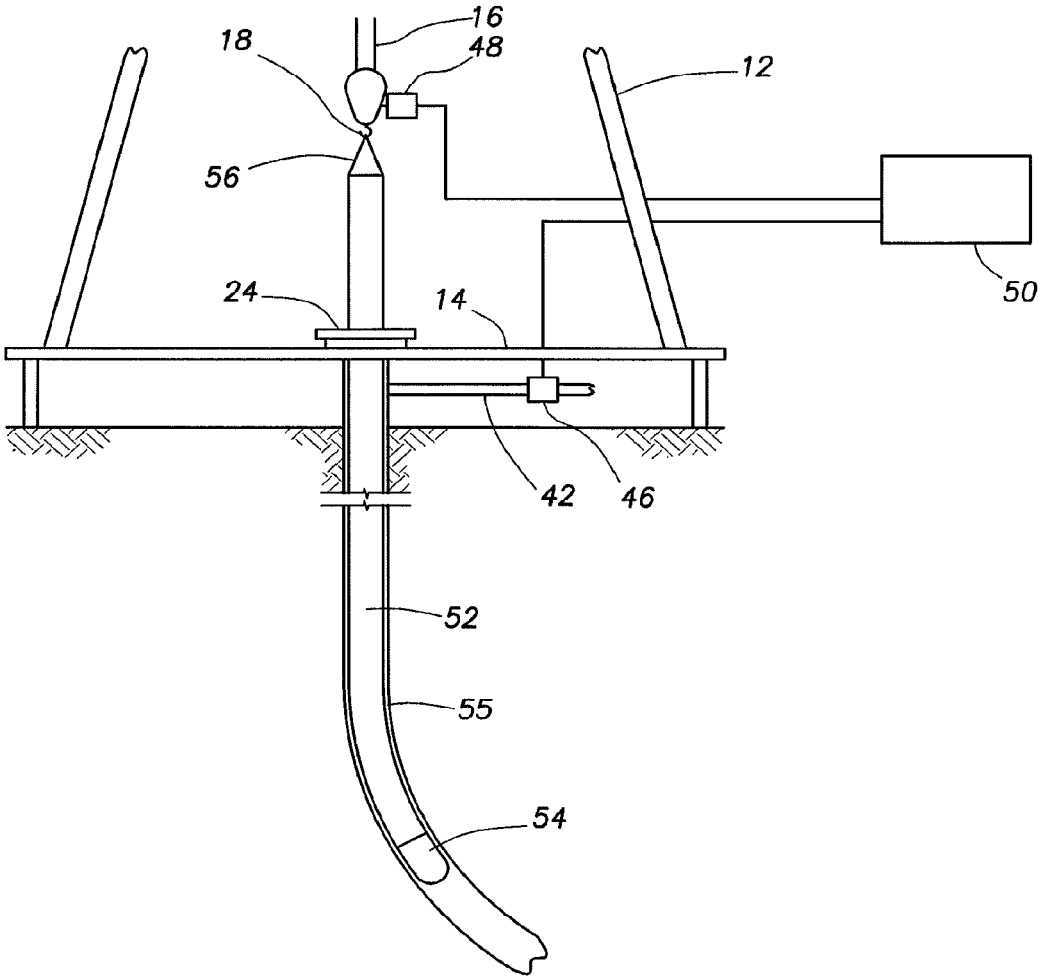
FIG. 2 depicts an operation in which a section of casing is inserted into a well.

After the well has been drilled to a certain depth, has shown in FIG. 2, a length of casing 52 is lowered into the well bore in sections. The first section 54, called a casing shoe, has a specialized purpose, as will be discussed below. As it is being lowered, the section of casing is suspended from casing hangar 56, which hangs from the hook 18. After the casing 52 is position, it is cemented into place. Cement is pumped down through the center of casing 52 to a casing shoe 54 at the bottom of casing 52 where it escapes through a port (not shown) in the casing shoe 54. The cement then flows up the annulus 55 between the casing 52 and the surrounding formations.

Hookload is the total effective weight of the apparatus attached to the hook (e.g., BHA, tubing, casing, etc.). Hookload is typically monitored, for example, to determine the weight on bit in a drilling operation, or to ensure that the load does not exceed any weight limitations of the derrick or other equipment. However, in conventional operations, hookload is generally not logged or recorded.

In some cases, hookload may be increased or decreased by various phenomena in the well bore in which the apparatus is disposed. For example, the buoyancy of the apparatus in any fluids (e.g., cement, drilling mud, etc.) present in the well bore may decrease the hookload by a certain amount depending on, among other things, the volume, density, and/or composition of the fluids in the well bore. If the volume and composition of the fluid(s) in the well bore (as well as other downhole parameters) are known, the buoyed hookload of an apparatus in that fluid may be calculated.

In one embodiment, the hookload $W_b$ of an apparatus made of a single type of material in a vertical hole in which a homogenous fluid is present may be represented by Equations (1) and (2) below:

$$W_b = W_O \times K_b \tag{1}$$

$$K_b = (65.5 - D_f)/65.5 = 1 = (SG_f/SG_a) \tag{2}$$

wherein $K_b$ is a buoyancy factor, $W_O$ is the weight of the apparatus in air, $D_f$ is the weight of the fluid in pounds per gallon, $SG_f$ is the specific gravity of the fluid, and $SG_a$ is the specific gravity of the material from which the apparatus is constructed.

In another embodiment, the hookload of an apparatus can be represented as a function of the density of the fluid in the well bore. For example, the hookload per foot $W_{b/ft}$ of an apparatus in a vertical hole may be represented by Equations (3) and (4) below:

$$W_{b/ft} = W_O - W_{fluid} \tag{3}$$

$$W_O = (MW_{Annular} \times A_{External}) - (MW_{Internal} \times A_{Internal}) \tag{4}$$

wherein $W_O$ is the weight of the apparatus in air, $W_{fluid}$ is the weight per foot of the fluid, $MW_{Annular}$ is the annular mud weight at the depth of the apparatus in the well bore, $MW_{Internal}$ is the internal mud weight at the depth of the apparatus inside the apparatus, $A_{External}$ is the external area of the apparatus, and $A_{internal}$ is the internal area of the apparatus.

$A_{External}$ and $A_{Internal}$ may vary depending on the structure of the apparatus. For apparatus without tool joints, $A_{External}$ and $A_{Internal}$ may be represented by Equations (5) and (6) below:

$$A_{External} = \pi/4 \times (OD_{Body})^2 \tag{5}$$

$$A_{Internal} = \pi/4 \times (ID_{Body})^2 \tag{6}$$

wherein $OD_{Body}$ is the outside diameter of the apparatus body, $ID_{Body}$ is the inside diameter of apparatus body. For apparatus with tool joints (i.e., assuming that 95% of the apparatus length comprises pipe body and 5% of the apparatus length comprises tool joints), $A_{External}$ and $A_{Internal}$ may be represented by Equations (7) and (8) below:

$$A_{External} = \pi/4 \times (0.95 \times (OD_{Body})^2 + 0.05 \times (OD_{Joint})^2) \tag{7}$$

$$A_{External} = \pi/4 \times (0.95 \times (ID_{Body})^2 + 0.05 \times (ID_{Joint})^2) \tag{8}$$

wherein $OD_{Joint}$ is the outside diameter of the tool joint and $ID_{Joint}$ is the inside diameter of the tool joint.

Where different fluids of differing weights are present in a well bore, the overall fluid density may be represented as a function of the height of each fluid column and the fluid density. Therefore, measurement of the fluid density and volume entering the well bore may provide a known measurement for the overall weight of fluid acting on the annular side ($MW_{Annular}$ in Equation (4) above) of the system. It is therefore possible to model the development of buoyancy change with known measurements of fluid volume and density during pumping operations.

The equations above may be further expanded by accounting for additional effects on hookload and/or surface tension due to other known parameters in the well bore, for example, the structure of the apparatus, deviation of the well bore from vertical (which causes a portion of the weight of the apparatus to rest against the well bore wall), non-homogenous fluid compositions, application of pump pressure (e.g., for drilling fluids) inside the drill string, and other phenomena. Formulas for the effects of these phenomena are known in the art and a person of skill in the art, with the benefit of this disclosure, will recognize how to apply them to the methods and systems of the present disclosure.

For example, the buoyancy factor $K_b$ for a drill string constructed of steel with a specific gravity of 7.8 comprising the components as described in Table 1 below in a drilling fluid having a specific gravity of 1.5 may be calculated according to Equation (9) below.

$$K_b=1-(1.5/7.8)=0.81 \tag{9}$$

TABLE 1

| Tubular: | Unit weight (kN/m) | Total length (m) | Total weight (kN) |
|---|---|---|---|
| 5 × 4 in drill string | 0.294 | 2658 | 781 |
| 8 × 3 in.drill collars | 2.13 | 200 | 426 |
| Total weight (kN) | 1207 | | |

In a deviated well having a well path as described in Table 2 below, the buoyed hookload $W_b$ of that drill string may be calculated according to Equation (10) below.

$$W_b=0.81\{(0.294\text{ kN/m}\times 2000\text{ m})+(2.13\text{ kN/m}\times 100\text{ m})\}=649\text{ kN} \tag{10}$$

TABLE 2

| Position: | Depth mTVD | Depth mMD | Inclination (°) | Radius (m) |
|---|---|---|---|---|
| Kick-off depth | 1000 | 1000 | 0 | — |
| End build-up | 1433 | 1524 | 0-60 | 500 |
| Top drill collars | 2000 | 2658 | 60 | — |
| Drill bit | 2100 | 2858 | 60 | — |

If fluid loss occurs to the formation, the volume of fluid in the well bore will change, which may change the height of the column of fluids in the well bore. Fluid height $H_f$ in a well bore in which an apparatus is present may be represented by Equation (11) below:

$$H_f=V_f/C_a \tag{11}$$

wherein $V_f$ is the volume of fluid pumped into the well bore in barrels and $C_a$ is the annular capacity of the well bore in barrels per foot, which may be represented by Equation (12) below:

$$C_a=(ID_{hole}^2-OD_{app}^2)/1029.4 \tag{12}$$

wherein $ID_{hole}$ is the diameter of the well bore and $OD_{app}$ is the outer diameter of the apparatus. Because each fluid applies a pressure to an apparatus over its column height, this may alter the buoyed hookload of the apparatus in the well bore. The pressure at any point in the well is derived from a sum of all the pressures acting on it. We can therefore calculate an overall pressure at any depth and the effective fluid density of all the individual columns.

For example, in a well bore having a depth of 5000 ft, fluids having the densities listed in Table 3 below may exert the pressures listed below.

TABLE 3

| Vertical Height (ft) | Density (ppg) | Pressure (psi) |
|---|---|---|
| 0-1000 | 9 | 468 |
| 1000-5000 | 15 | 3120 |

At 5000 ft, the total pressure in this well bore would be 3588 psi, i.e., the sum of the individual fluid columns in the well. The effective fluid density at a particular depth may be calculated according to Equation (13) below.

$$\text{Effective Fluid Density}=\text{Pressure}/(\text{Depth}\times 0.052) \tag{13}$$

Thus, at 5000 ft, the effective fluid density in the well bore described in Table 3 is equivalent to a single fluid column of 13.8 ppg. These values may be used to model the calculated buoyed hookload for an apparatus in a well bore.

Figure 3:
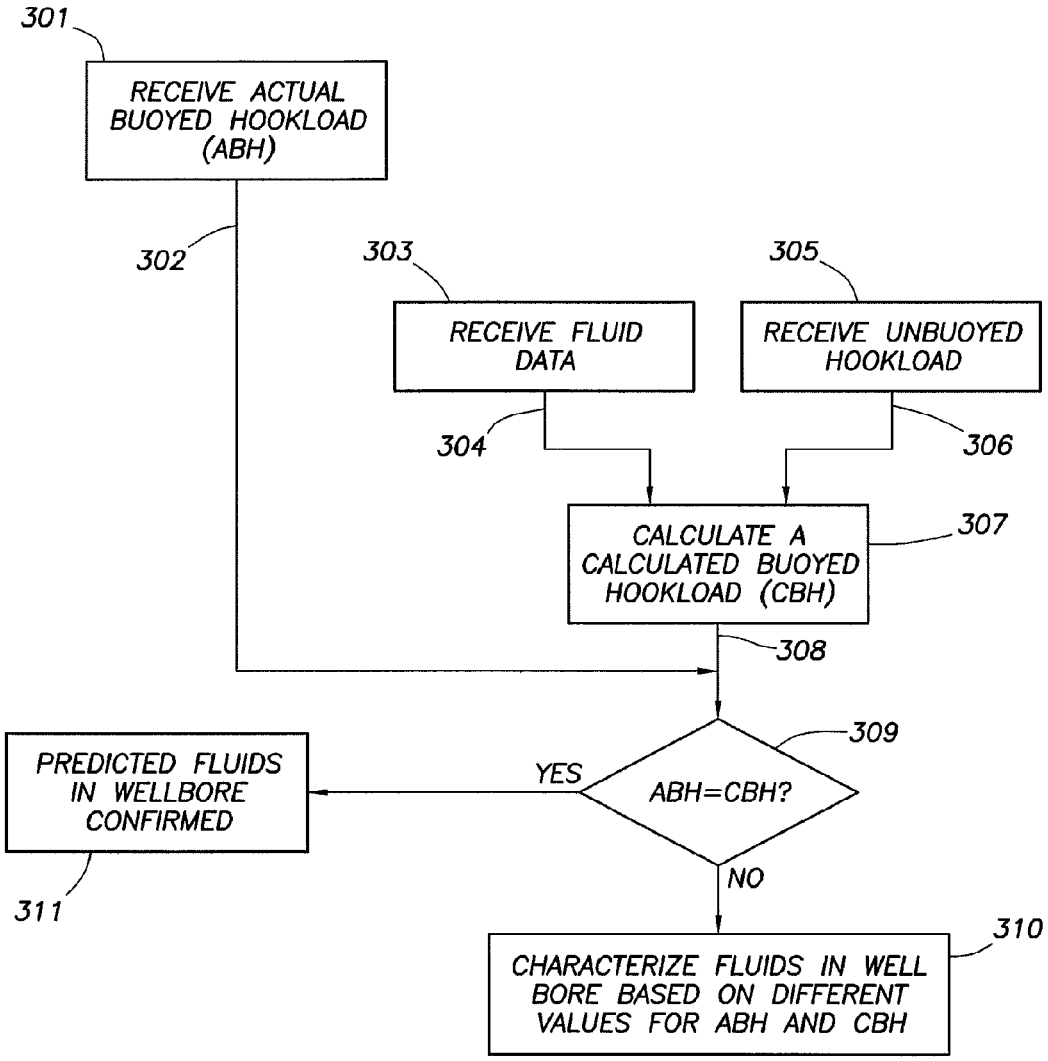
FIG. 3 is a flowchart depicting a method of monitoring fluids according to one embodiment of the present disclosure.

Turning now to FIG. 3, general method steps in accordance with an exemplary embodiment of the present disclosure are denoted with reference numeral 300. At step 301, the system receives data 302 regarding the actual (measured) buoyed hookload of an apparatus at least partially disposed in a well bore where one or more fluids are present. At step 303, the system receives data 304 regarding the volume, density, and/or composition of fluids assumed to be present in the well bore (e.g., fluids that have been introduced into the well bore during a subterranean operation), for example, from sensors along a mud supply and/or return line, at a mud or cement tank, and/or at a fluid pumping truck. At step 305, the system receives data 306 regarding the unbuoyed hookload or weight of an apparatus prior to being lowered into the well bore. Data 306 may be obtained using the same equipment as that used in step 302, or it may be provided to the system directly based on previously-recorded data regarding the weight of the apparatus or its components. At step 307, the system uses data 304 and 306 (as well as any additional data provided) to calculate a calculated buoyed hookload 308 of the apparatus in the well bore. In certain embodiments, the system may receive additional data regarding other phenomena and/or parameters in the well, such as the deviation of the well bore, temperature in the well bore, and the like, and use that data to perform the calculation in step 307. While steps 301, 303, 305, and 307 are described in a particular order, these steps may be performed in a different order, or two or more of those steps may be performed substantially simultaneously with each other and/or during operations in which the apparatus is disposed in the well bore (i.e., substantially in or near real time).

In step 309, the system compares the actual buoyed hookload 302 to the calculated buoyed hookload 308. Assuming that other downhole parameters and variables have been accounted for, if the values for the actual buoyed hookload 302 and the calculated buoyed hookload 308 are the same, this may confirm in step 311 that the composition and/or volume of fluids in the well bore are correctly predicted based on the data received in step 303 (and any other well bore data used in step 307). However, if the values for the actual buoyed hookload 302 and the calculated buoyed hookload 308 differ, this may indicate that volume and/or composition of the fluid in the well bore has been altered by some phenomena or activity downhole. In certain embodiments, these different values can then be used to characterize the fluids present in the well bore in step 310. For example, the different values for the actual buoyed hookload 302 and the calculated buoyed hookload 308 may indicate that some amount of fluids introduced into the well bore (e.g., drilling fluids, cement, etc.) may have migrated into a portion of the subterranean formation. In other embodiments, the different values for the actual buoyed hookload 302 and the calculated buoyed hookload 308 may indicate that water from the formation may have migrated or flowed into a portion of the well bore. Thus, the deviation of the actual buoyed hookload from a calculated buoyed hookload may be used to detect the migration of well bore fluids into the formation (i.e., fluid loss), water production, or other downhole phenomena in real-time. In some embodiments, the identity and amount of fluids migrating from or entering into the well bore may be determined based on the difference between the actual buoyed hookload and the calculated buoyed hookload.

The system and methods of the present disclosure may, among other benefits, provide a low-cost method of detecting fluid loss early in an operation based primarily on surface measurements that require little or no downhole intervention or measurements. The early detection of fluid loss also may increase the efficiency of certain subterranean operations by helping operators to correct fluid loss problems sooner, reducing the need to repeat unsuccessful operations or steps in those operations. Also, by permitting operators to identify the specific fluid being lost into a subterranean formation, the systems and methods of the present disclosure may facilitate more efficient remedial and/or clean-up operations.

If the fluid lost into the formation is identified as a cement, this may inform the operator of the reason why the cement did not cure or set in its intended location, and may, among other benefits, allow the operator to more efficiently correct the condition causing cement loss downhole so that the cementing operation may be performed properly.

The calculated and actual buoyed hookload may be calculated and/or measured at a series of time intervals over a longer period of time, and may be compared and/or plotted together at each interval. A person of skill in the art, with the benefit of this disclosure, will be able to select time intervals appropriate for a particular application of the present disclosure. In certain embodiments, the calculated and actual buoyed hookload values may be calculated, measured, and/or recorded substantially continuously during the course of an operation and compared or plotted over that continuous period of time. In one embodiment, the data is pushed at or near real-time enabling real-time communication, monitoring, and reporting capability. This may, among other benefits, allow an operator to continuously monitor the status of the well bore and detect fluid loss from or fluid production into the well bore at approximately the time that it occurs (or shortly thereafter), and allow the collected data to be used in a streamline workflow in a real-time manner by other systems and operators concurrently with acquisition.

Referring back to FIGS. 1 and 2, fluid measurement devices (i.e., sensors, gauges, or scales) 46 and 47 may be positioned along the mud supply and return lines 38 and 42 or at the mud pit (not shown) and configured to monitor the volume, density, and/or other properties of drilling muds or other fluids pumped into and/or exiting the well bore. Sensors or gauges also may be positioned at the cement tank or truck or along the cement supply line (not shown) that are configured to monitor the volume, density, and/or other properties of cement pumped into the well bore. These gauges or sensors may comprise any type of sensor device known in the art capable of monitoring these properties, including but not limited to acoustic sensors, nuclear sensors, coriolis meters, doppler radar, vortex flow meters or sensors, calorimetric flow meters or sensors, magnetic flow meters or sensors, electromagnetic meters or sensors, differential pressure meters or sensors, open channel meters or sensors, and the like. At mud or cement tanks, weight scales may be used to monitor the volume of fluids pumped into or exiting the well bore.

A hookload sensor 48 also may be placed between the hook 18 and draw works 16 to measure the hookload (buoyed or unbuoyed) of a casing string or drill string suspended from the hook. Various types of devices suitable for measuring hookload are known in the art, and include but are not limited to strain gauges, spring gauges, load cells, fiber optic sensors, pressure transmitters, transducers, and the like. In certain embodiments of the present disclosure, types of equipment with increased sensitivity may be preferable over other types of equipment in order to provide more accurate hookload measurements used in the calculations described herein.

In certain embodiments, the volume of the well bore may be calculated or measured and used to calculate the calculated buoyed hookload in step 307. This may be accomplished using any methods known in the art, including but not limited to caliper logging, acoustic logging, gamma ray logging, visual logging, resistivity logging, magnetic susceptibility logging, electromagnetic logging, and the like.

Referring back to FIGS. 1 and 2, a data acquisition and control interface 50 may be communicatively coupled to the sensors 48 that are used to measure hookload, sensors used to monitor fluids pumped into or exiting the well bore (e.g., sensors 46 and 47), and/or sensors at other locations in the system. The data acquisition and control interface may be used to receive and/or record data regarding hookload measurements, fluid pumping data, and any other data, parameters, or other information regarding operation and activity in the system. The data acquisition and control interface may be located at a rig site or at a remote location.

Any suitable processing application software package may be used by the data acquisition and control interface 50 to process the data. In one embodiment, the software produces data that may be presented to the operation personnel in a variety of visual display presentations such as a display. In certain example system, the measured value set of parameters, the expected value set of parameters, or both may be displayed to the operator using the display. For example, the measured-value set of parameters may be juxtaposed to the expected-value set of parameters using the display, allowing the user to manually identify, characterize, or locate a downhole condition. The sets may be presented to the user in a graphical format (e.g., a chart) or in a textual format (e.g., a table of values). In another example system, the display may show warnings or other information to the operator when the central monitoring system detects a downhole condition. Suitable data acquisition and control interfaces for use as the data acquisition and control interface 50 are SENTRY™ and INSITE™ provided by Halliburton Energy Services, Inc. Any suitable data acquisition and control interface may be used in keeping with the principles of this disclosure.

In certain embodiments, the data acquisition and control interface may be communicatively coupled to an external communications interface. The external communications interface may permit the data from the data acquisition and control interface to be remotely accessible by any remote information handling system communicatively coupled to the external communications interface via, for example, a satellite, a modem or wireless connections. In one embodiment, the external communications interface may include a router.

In accordance with an exemplary embodiment of the present disclosure, once feeds from one or more sensors are obtained, they may be combined and used to identify various metrics. For instance, if there is data that deviates from normal expectancy at the rig site, the combined system may show another reading of the data from another sensor that may help identify the type of deviation. As would be appreciated by those of ordinary skill in the art, with the benefit of this disclosure, a data acquisition and control interface may also collect data from multiple rigsites and wells to perform quality checks across a plurality of rigs.

As would be appreciated by those of ordinary skill in the art, with the benefit of this disclosure, one or more information handling systems may be used to implement the methods disclosed herein. In certain embodiments, the different information handling systems may be communicatively coupled through a wired or wireless system to facilitate data transmission between the different subsystems. Moreover, each information handling system may include a computer readable media to store data generated by the subsystem as well as preset job performance requirements and standards.

The systems and methods of the present disclosure may be used to monitor fluids, characterize fluids, and/or detect fluid loss in conjunction any subterranean operation involving the applicable equipment. For example, the systems and methods of the present disclosure may be used in cementing operations, stimulation operations (e.g., fracturing, acidizing, etc.), completion operations, remedial operations, drilling operations, and the like. A person of skill in the art, with the benefit of this disclosure, will recognize how to apply or implement the systems and methods of the present disclosure as disclosed herein in a particular operation.

In certain embodiments, the systems and methods of the present disclosure also may be used in conjunction with certain systems and methods used to calculate the position of various fluids in a well bore and/or certain systems and methods used to verify the placement and/or curing of cement in a well bore. In certain embodiments, a system or method of the present disclosure may be used to detect when fluid loss occurs in a particular well bore and to identify the specific fluid that has been lost into the formation. That same system or another system may be capable of using various pumping data parameters to determine the height and relative position of that fluid along the well bore when the fluid loss was detected. This may, among other benefits, allow operators to pinpoint the locations in the well bore where fluid loss treatments or other remedial treatments should be performed. In certain embodiments, a system or method of the present disclosure may be used to detect fluid loss in a particular well bore and to identify the specific fluid that has been lost into the formation. That same system or another system may use data regarding the volume, temperature, and pressure of fluids exiting the well bore to determine that a cement did not cure in its intended location. If the fluid lost into the formation is identified as a cement, this may inform the operator of the reason why the cement did not cure or set in its intended location, and may, among other benefits, allow the operator to more efficiently correct the condition causing cement loss downhole so that the cementing operation may be performed properly.

An embodiment of the present disclosure is a fluid monitoring system that includes a data acquisition and control interface, a hookload measurement device communicatively coupled to the data acquisition and control interface that is configured to measure a hookload of an apparatus at least partially disposed in a well bore, and one or more fluid measurement devices communicatively coupled to the data acquisition and control interface that are configured to detect volumes of one or more fluids pumped into or exiting the well bore, wherein the data acquisition and control interface receives data relating to an actual buoyed hookload of the apparatus from the hookload measurement equipment and data relating to one or more fluids pumped into or exiting the well bore from the one or more fluid measurement devices, and wherein the data acquisition and control interface uses the data received from the hookload measurement equipment and the one or more fluid measurement devices to determine one or more properties of one or more fluids present in the well bore. Optionally, the system further includes one or more fluid measurement devices communicatively coupled to the data acquisition and control interface that are configured to detect the density of one or more fluids pumped into or exiting the well bore. Optionally, the data acquisition and control interface is communicatively coupled to an external communications interface that permits data from the data acquisition and control interface to be remotely accessed by a remote information handling system communicatively coupled to the external communications interface. Optionally, the data acquisition and control interface is further configured to receive data relating to the actual buoyed hookload and the one or more fluids pumped into or exiting the well bore and use the data to determine one or more properties of one or more fluids present in the well bore substantially in or near real time. Optionally, the data acquisition and control interface is further configured to determine a volume of one or more fluids in the well bore. Optionally, the data acquisition and control interface is further configured to determine a composition of one or more fluids in the well bore. Optionally, the data acquisition and control interface receives data relating to at least one parameter selected from the group consisting of deviation of at least a portion of the well bore, the temperature in at least a portion of the well bore, the structure of the apparatus, and any combination thereof, and the data acquisition and control interface uses the data relating to the at least one parameter to determine one or more properties of one or more fluids present in the well bore.

Another embodiment of the present disclosure is a method for monitoring fluids in a well bore penetrating a subterranean formation, the method including the steps of determining an actual buoyed hookload of an apparatus at least partially disposed in the well bore wherein a first set of fluids are present therein, comparing the actual buoyed hookload to a calculated buoyed hookload of the apparatus, wherein the calculated buoyed hookload is based in part on the unbuoyed hookload of the apparatus, and the properties of a second set of fluids that are assumed to be present in the well bore, and determining at least one property of the first set of fluids based in part on the comparison of the actual buoyed hookload to the calculated buoyed hookload. Optionally, the properties of the second set of fluids includes one or more densities of the second set of fluids. Optionally, the determining step includes determining that the first set of fluids is substantially the same as the second set of fluids assumed to be present in the well bore. Optionally, the determining step includes determining a composition of one or more of the first set of fluids in the well bore. Optionally, the calculated hookload of the apparatus is further based on at least one parameter selected from the group consisting of deviation of at least a portion of the well bore, the temperature in at least a portion of the well bore, the structure of the apparatus, and any combination thereof. Optionally, the apparatus includes a drillstring, a casing string, and/or one or more tool joints. Optionally, the second set of fluids assumed to be present in the well bore includes fluids introduced into the well bore during a subterranean operation. Optionally, the method further includes determining that a portion of the fluids introduced into the well bore have migrated into a portion of the subterranean formation. Optionally, the steps of determining the actual buoyed hookload of the apparatus, comparing the actual buoyed hookload to the calculated buoyed hookload of the apparatus, and determining at least one property of the first set of fluids are performed substantially in or near real time. Optionally, the method of further includes accessing data regarding one or more of the actual buoyed hookload, the calculated buoyed hookload, and the properties of the first and second sets of fluids from a remote location.

Another embodiment of the present disclosure is a fluid monitoring system that includes a data acquisition and control interface communicatively coupled to an external communications interface that permits data from the data acquisition and control interface to be remotely accessed by a remote information handling system communicatively coupled to the external communications interface, a hookload measurement device communicatively coupled to the data acquisition and control interface that is configured to measure a hookload of an apparatus at least partially disposed in a well bore, and one or more fluid measurement devices communicatively coupled to the data acquisition and control interface that are configured to detect volumes of one or more fluids pumped into or exiting the well bore, wherein the data acquisition and control interface receives data relating to an actual buoyed hookload of the apparatus from the hookload measurement equipment and data relating to one or more fluids pumped into or exiting the well bore from the one or more fluid measurement devices, and wherein the data acquisition and control interface uses the data received from the hookload measurement equipment and the one or more fluid measurement devices to determine one or more properties of one or more fluids present in the well bore substantially in real time.

Therefore, the present disclosure is well-adapted to carry out the objects and attain the ends and advantages mentioned as well as those which are inherent therein. While the disclosure has been depicted and described by reference to exemplary embodiments of the disclosure, such a reference does not imply a limitation on the disclosure, and no such limitation is to be inferred. The disclosure is capable of considerable modification, alteration, and equivalents in form and function, as will occur to those ordinarily skilled in the pertinent arts and having the benefit of this disclosure. The depicted and described embodiments of the disclosure are exemplary only, and are not exhaustive of the scope of the disclosure. The terms in the claims have their plain, ordinary meaning unless otherwise explicitly and clearly defined by the patentee.

What is claimed is:

1. A fluid monitoring system comprising:

a data acquisition and control interface;

a hookload measurement device communicatively coupled to the data acquisition and control interface that is configured to measure a hookload of an apparatus at least partially disposed in a well bore; and one or more fluid measurement devices communicatively coupled to the data acquisition and control interface that are configured to detect volumes of one or more fluids pumped into or exiting the well bore;

wherein the data acquisition and control interface receives data relating to an actual buoyed hookload of the apparatus from the hookload measurement equipment and data relating to one or more fluids pumped into or exiting the well bore from the one or more fluid measurement devices;

wherein the data acquisition and control interface uses the data received from the hookload measurement equipment and the one or more fluid measurement devices to determine one or more properties of one or more fluids present in the well bore.

2. The system of claim 1 further comprising one or more fluid measurement devices communicatively coupled to the data acquisition and control interface that are configured to detect the density of one or more fluids pumped into or exiting the well bore.

3. The system of claim 1 wherein the data acquisition and control interface is communicatively coupled to an external communications interface that permits data from the data acquisition and control interface to be remotely accessed by a remote information handling system communicatively coupled to the external communications interface.

4. The system of claim 1 wherein the data acquisition and control interface is further configured to receive data relating to the actual buoyed hookload and the one or more fluids pumped into or exiting the well bore and use the data to determine one or more properties of one or more fluids present in the well bore substantially in or near real time.

5. The system of claim 1 wherein the data acquisition and control interface is further configured to determine a volume of one or more fluids in the well bore.

6. The system of claim 1 wherein the data acquisition and control interface is further configured to determine a composition of one or more fluids in the well bore.

7. The system of claim 1 wherein the data acquisition and control interface receives data relating to at least one parameter selected from the group consisting of: deviation of at least a portion of the well bore, the temperature in at least a portion of the well bore, the structure of the apparatus, and any combination thereof; and the data acquisition and control interface uses the data relating to the at least one parameter to determine one or more properties of one or more fluids present in the well bore.

8. A method for monitoring fluids in a well bore penetrating a subterranean formation, the method comprising:

disposing, at least partially, an apparatus in the wellbore, wherein a first set of fluids is present within the wellbore;

determining, by a hookload measuring device, an actual buoyed hookload of the apparatus;

comparing, by a data acquisition device communicatively coupled to the hookload measuring device, the actual buoyed hookload to a calculated buoyed hookload of the apparatus, wherein the calculated buoyed hookload is based in part on an unbuoyed hookload of the apparatus, and properties of a second set of fluids that are assumed to be present in the well bore; and determining at least one property of the first set of fluids based in part on the comparison of the actual buoyed hookload to the calculated buoyed hookload.

9. The method of claim 8 wherein the properties of the second set of fluids comprises one or more densities of the second set of fluids.

10. The method of claim 8 wherein the determining step comprises determining that the first set of fluids is substantially the same as the second set of fluids assumed to be present in the well bore.

11. The method of claim 8 wherein the determining step comprises determining a composition of one or more of the first set of fluids in the well bore.

12. The method of claim 8 wherein the calculated hookload of the apparatus is further based on at least one parameter selected from the group consisting of: deviation of at least a portion of the well bore, the temperature in at least a portion of the well bore, the structure of the apparatus, and any combination thereof.

13. The method of claim 8 wherein the apparatus comprises a drillstring.

14. The method of claim 8 wherein the apparatus comprises a casing string.

15. The method of claim 8 wherein the apparatus comprises one or more tool joints.

16. The method of claim 8 wherein the second set of fluids assumed to be present in the well bore comprise fluids introduced into the well bore during a subterranean operation.

17. The method of claim 16 further comprising determining that a portion of the fluids introduced into the well bore have migrated into a portion of the subterranean formation.

18. The method of claim 8 wherein the steps of determining the actual buoyed hookload of the apparatus, comparing the actual buoyed hookload to the calculated buoyed hookload of the apparatus, and determining at least one property of the first set of fluids are performed substantially in or near real time.

19. The method of claim 8 further comprising accessing data regarding one or more of the actual buoyed hookload, the calculated buoyed hookload, and the properties of the first and second sets of fluids from a remote location.

20. A fluid monitoring system comprising:

a data acquisition and control interface communicatively coupled to an external communications interface that permits data from the data acquisition and control interface to be remotely accessed by a remote information handling system communicatively coupled to the external communications interface;

a hookload measurement device communicatively coupled to the data acquisition and control interface that is configured to measure a hookload of an apparatus at least partially disposed in a well bore; and one or more fluid measurement devices communicatively coupled to the data acquisition and control interface that are configured to detect volumes of one or more fluids pumped into or exiting the well bore;

wherein the data acquisition and control interface receives data relating to an actual buoyed hookload of the apparatus from the hookload measurement equipment and data relating to one or more fluids pumped into or exiting the well bore from the one or more fluid measurement devices;

wherein the data acquisition and control interface uses the data received from the hookload measurement equipment and the one or more fluid measurement devices to determine one or more properties of one or more fluids present in the well bore substantially in real time.

* * * * *